US007465216B2

(12) United States Patent
Iwasaki et al.

(10) Patent No.: US 7,465,216 B2
(45) **Date of Patent: *Dec. 16, 2008**

(54) POLISHING APPARATUS

(75) Inventors: Masanobu Iwasaki, Tokyo (JP); Yoshio Hayashide, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/878,028

(22) Filed: Jul. 20, 2007

(65) Prior Publication Data

US 2007/0264908 A1 Nov. 15, 2007

Related U.S. Application Data

(63) Continuation of application No. 09/934,474, filed on Aug. 23, 2001, now Pat. No. 7,258,598.

(30) Foreign Application Priority Data

Nov. 29, 2000 (JP) ..... 2000-363478

(51) Int. Cl.
*B24B 51/00* (2006.01)
*B24B 1/00* (2006.01)
*B24B 57/00* (2006.01)

(52) U.S. Cl. ..... 451/5; 451/60; 451/446

(58) Field of Classification Search ..... 451/446, 451/41, 60, 287, 288, 5; 156/345.12; 438/693
See application file for complete search history.

(56) References Cited

U.S. PATENT DOCUMENTS 3,979,239 A 9/1976 Walsh
5,478,435 A * 12/1995 Murphy et al. ..... 156/345.12
5,643,406 A 7/1997 Shimomura et al.
5,679,063 A 10/1997 Kimura et al.
5,716,264 A 2/1998 Kimura et al.
5,857,893 A 1/1999 Olsen et al.
5,885,134 A 3/1999 Shibata et al.
5,997,392 A 12/1999 Chamberlin et al.
6,048,256 A 4/2000 Obeng et al.
6,059,920 A 5/2000 Nojo et al.
6,123,602 A 9/2000 Rodriguez et al.
6,241,581 B1 6/2001 Miyashita et al.
6,283,835 B1 9/2001 Harada et al.
6,293,849 B1 9/2001 Kawashima

FOREIGN PATENT DOCUMENTS

JP 9-148286 6/1987
JP 9-199455 7/1997
JP 10-202525 8/1998
JP 2000-117636 4/2000

* cited by examiner

*Primary Examiner*—Hadi Shakeri
(74) *Attorney, Agent, or Firm*—McDermott Will & Emery LLP

(57) ABSTRACT

A first supply unit sprays and supplies abrasive slurry containing abrasive grains into a mixing unit. A second supply unit sprays and supplies additive into the mixing unit. A third supply unit sprays and supplies pure water into the mixing unit. The mixing unit mixes the mist of abrasive slurry, the mist of additive and the mist of pure water to prepare polishing solution, and supplies the polishing solution onto the major surface of a polishing stage.

1 Claim, 7 Drawing Sheets

BACKGROUND ART

POLISHING APPARATUS

This application is a Continuation of U.S. application Ser. No. 09/934,474, filed Aug. 23, 2001, now U.S. Pat. No. 7,258,598 claiming priority of Japanese Application No. 2000-363478, filed Nov. 29, 2000, the entire contents of each of which are hereby incorporated by reference.

BACKGROUND OF THE INVENTION

1. Field of the Invention

The present invention relates to an apparatus for polishing a semiconductor substrate and to a polishing method of a semiconductor substrate. More particularly, the present invention relates to a polishing solution supply system and to a method of supplying a polishing solution to the polishing apparatus.

2. Description of the Background Art

With downsizing of semiconductor integrated circuits, it has become essential to secure the flatness of interlayer insulation films. This is because the margin for the depth of focus in the photolithography processes contracts, or the margin for the quantity of over-etching in the etching processes contracts, unless the flatness of the interlayer insulation films is secured.

The following methods are given as method of flattening interlayer insulation films.

The first method is to form a BPSG (borophosphosilicate glass) film on a semiconductor substrate, and then the BPSG film is subjected to heat treatment to cause the viscous flow of the film so as to flatten the film.

The second method is to fill the depression formed on a substrate using SOG (spin on glass), and then to form an interlayer insulation film so as to flatten the film.

The third method is to apply a photoresist onto an interlayer insulation film, and to etch the photoresist and the interlayer insulation film in the same selection ratio so as to flatten the film.

The fourth method is to flatten the interlayer insulation film using the CMP (chemical mechanical polishing) method.

Further, various modifications by combining the above-described methods have also been proposed.

Next, with reference to FIGS. 9A to 9C, a conventional method of manufacturing a semiconductor device using the CMP method will be described.

First, a wiring layer (not shown) is formed on a semiconductor substrate 101.

Here, a dummy pattern is disposed of the wiring layer so as to match the occupancy ratio of patterns. However, due to various limitations of the device structure, the portions where distances between patterns are dense and sparse, i.e., sparse-dense difference, are produced in the wiring layer.

Next, an interlayer insulation film 102 is formed on the wiring layer having the above-described sparse-dense difference. Thus, the structure shown in FIG. 9A is obtained. That is, a small protruded portions 102*a* and a large protruded portions 102*b* are formed on the surface of the interlayer insulation film 102 corresponding to the undulations of the underlying wiring layer.

Next, as shown in FIG. 9B, abrasive slurry containing silica abrasive grains 104 is supplied between the semiconductor substrate 101 and a polishing table 105, and polishing is performed using the CMP method.

As a result, the structure shown in FIG. 9C is obtained. That is, although the small protruded portions 102*a* have been polished, the large protruded portions 102*b*, for example of the millimeter order, have not been polished, and the interlayer insulation film 102 has not been flattened. Furthermore, in large protruded portions 102*b*, difference in thickness occurs between the center portions and the edge portions.

FIG. 10 is a cross-sectional view for describing the stress distribution applied to the polishing stage. As shown in FIG. 10, the distribution of stress "A" applied to the polishing table 105 becomes uneven in the interlayer insulation film 102 having the undulations. This results in difference in the polishing rate, causing poor flatness (see FIG. 9).

Thus, there has been a problem that the dimension of the protruded portions to be polished (for example, the interlayer insulation film 102) cause difference in the degree of flatness. That is, CMP using the abrasive slurry containing silica abrasive grains 104 has pattern dependency.

As described above, for devices having sparse-dense difference in the object to be polished due to structural limitation, methods for improving flatness have been proposed, such as methods disclosed in the Japanese patent documents whose publication No. 11-145,140 and No. 9-246,219.

In these methods, as shown in FIG. 11, a film to be polished is made to have a dual-layer structure, and as the upper-layer film to be polished, a thin film having a low polishing rate is disposed.

Specifically, as shown in FIG. 11A, a first interlayer insulation film 102 is formed on a semiconductor substrate 101.

Next, as shown in FIG. 11B, a second interlayer insulation film 106 is formed on the first interlayer insulation film 102.

Then, as shown in FIG. 11C, abrasive slurry containing silica abrasive grains 104 is supplied between the semiconductor substrate 101 and the polishing table 105, and polishing is performed using the CMP method.

As a result, a structure shown in FIG. 11D is obtained. Namely, flatness of the interlayer insulation film is improved.

However, since the film to be polished has the dual-layer structure in the methods disclosed in Japanese patent documents whose publication No. 11-145,140 and No. 9-246,219 (see FIG. 11), the number of masks for exposure and the number of process steps increase.

Consequently, there is a problem that the time taken for the manufacture of semiconductor devices becomes much longer. Also, there is another problem that the manufacturing costs become much higher.

In addition to the above-described improvement in the design and the structure, that is, the method of improving flatness by making the film to be polished to have a dual-layer structure, slurry that has a highly flattening function (hereafter called "highly flattening slurry") has been proposed in recent years.

Here, highly flattening slurry is conventional abrasive slurry, to which aqueous solution of organic acid or aqueous solution of hydrogen peroxide is added as additive.

However, the above-described highly flattening slurry has a problem that the abrasive slurry and the additive cannot be mixed well.

This is because abrasive grains coagulate when the additive is mixed with the abrasive slurry for preparing highly flattening slurry, and abrasive grains having a large particle diameter (hereafter called "coarse grains") are formed.

FIG. 12 is a drawing for describing a change in the number of abrasive grains contained in polishing solution. FIG. 12 shows a change in the number of coarse grains having a particle diameter of 1.66 μm or larger. As shown in FIG. 12, the number of coarse grains shows about four times increase after mixing the additive for imparting the highly flattening function.

The coarse grains increased in above-described polishing solution mixing cause scratch (polishing scratch) formed on the semiconductor substrate to increase. This scratch has a problem to lower the product yield in semiconductor manufacturing processes.

SUMMARY OF THE INVENTION

The present invention has been conceived to solve the previously-mentioned problems and a general object of the present invention is to provide a novel and useful polishing solution supply system, and is to provide a novel and useful apparatus for polishing a semiconductor substrate, and is to provide a novel and useful method of supplying a polish solution, and is to provide a novel and useful method of polishing a semiconductor substrate, and is to provide a novel and useful method of manufacturing a semiconductor device.

A more specific object of the present invention is to supply a polishing solution stably without causing the coagulation of abrasive grains when the polishing solution is prepared.

The above object of the present invention is attained by a following polishing solution supply system.

According to one aspect of the present invention, a polishing solution supply system comprises a polishing table for placing a semiconductor substrate on the major surface thereof; a first supply unit for spraying and supplying abrasive slurry; a second supply unit for spraying and supplying additive; a third supply unit for spraying and supplying pure water; and a mixing unit for mixing the mist of abrasive slurry supplied from the first supply unit, the mist of additive supplied from the second supply unit and the mist of pure water supplied from the third supply unit, the mixing unit supplying the mixture onto the major surface of the polishing table.

In the polishing solution supply system, the coagulation of abrasive grains can be prevented when the mist of abrasive slurry, the mist of additive and the mist of pure water are mixed in a mixing unit to prepare the polishing solution.

According to another aspect of the present invention, a polishing solution supply system comprises a polishing table for placing a semiconductor substrate on the major surface thereof; a first supply unit for spraying and supplying abrasive slurry to a specified location on the major surface of the polishing table; a second supply unit for spraying and supplying additive onto the major surface of the polishing table so as to mix with the mist of abrasive slurry supplied from the first supply unit; and a third supply unit for spraying and supplying pure water onto the major surface of the polishing table so as to mix with the mist of abrasive slurry supplied from the first supply unit and with the mist of additive supplied from the second supply unit.

In the polishing solution supply system, the coagulation of abrasive grains can be prevented when the mist of abrasive slurry, the mist of additive and the mist of pure water are mixed on a polishing table to prepare the polishing solution.

Other objects and further features of the present invention will be apparent from the following detailed description when read in conjunction with the accompanying drawings.

DETAILED DESCRIPTION OF THE PREFERRED EMBODIMENTS

Figure 1:
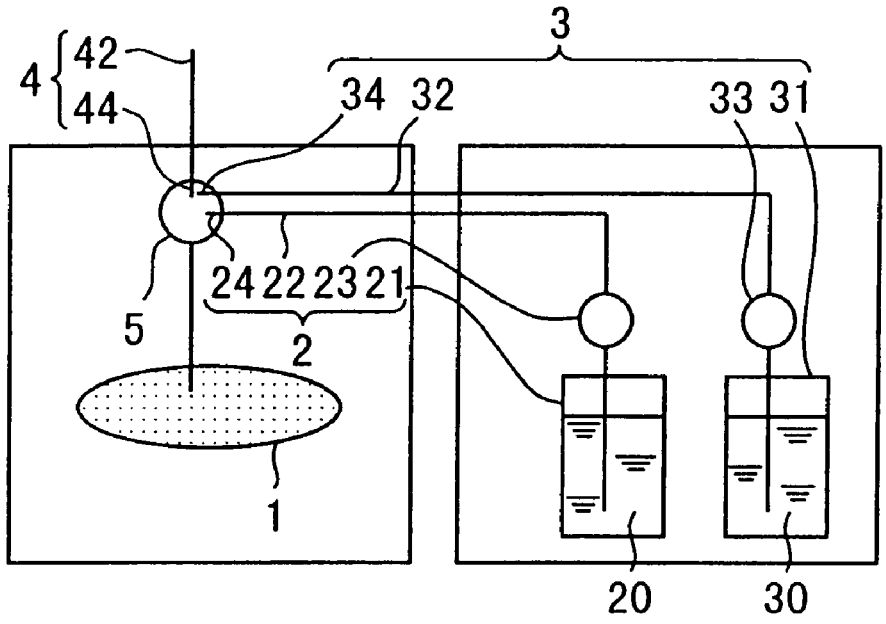
FIG. 1 is a conceptual view for describing a polishing solution supply system and a method of supplying polishing solution according to a first embodiment of the present invention.

In the following, principles and embodiments of the present invention will be described with reference to the accompanying drawings. The members and steps that are common to some of the drawings are given the same reference numerals and redundant descriptions therefore may be omitted.

First Embodiment

Figure 2:
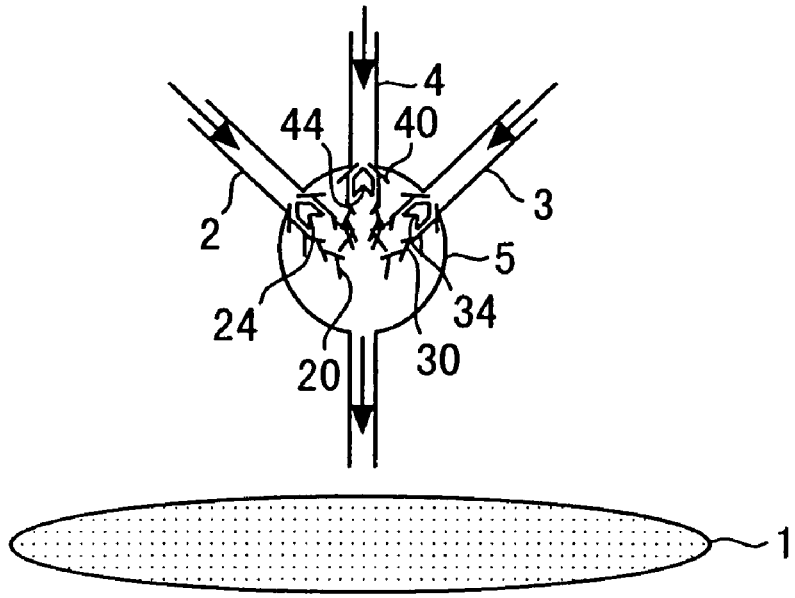
FIG. 2 is a cross-sectional view for describing the vicinity of the mixing unit shown in FIG. 1.

FIG. 1 is a conceptual view for describing a polishing solution supply system and a method of supplying polishing solution according to a first embodiment of the present invention. FIG. 2 is a cross-sectional view for describing the vicinity of the mixing unit shown in FIG. 1.

First, a polishing solution supply system according to the first embodiment will be described.

In FIGS. 1 and 2, the reference numeral 1 indicates a polishing table, 2 indicates a first supply unit, 3 indicates a second supply unit, 4 indicates a third supply unit, and 5 indicates a mixing unit. Also, the reference numeral 20 indicates abrasive slurry, 30 indicates additive, and 40 indicates pure water. Each of 21 and 31 indicates a tank, each of 22, 32 and 42 indicates a pipe, each of 23 and 33 indicates a pump and each of 24, 34 and 44 indicates a spray unit.

The polishing table 1 is a polishing pad (also called "CMP pad"). Although not shown, a semiconductor substrate is disposed on the major surface of the polishing table 1.

The first supply unit 2 is adopted to spray and supply the abrasive slurry 20, which constitutes the polishing solution (not shown), into the mixing unit 5. Here, the abrasive slurry 20 is slurry containing abrasive grains consisting, for example, of silica or ceria.

The first supply unit 2 is furnished with the tank 21 for storing the abrasive slurry 20; the pipe 22 for supplying the abrasive slurry 20 to the mixing unit 5 from the tank 21; the pump 23 for supplying the abrasive slurry 20 in the tank 21 to the pipe 22 under a desired pressure; and the spray unit 24 (See FIG. 2: details will be described below.) for spraying the abrasive slurry 20 supplied through the pipe 22 into the mixing unit 5. Although not shown, a plurality of valves is provided on the pipe 22.

The first supply unit 2 is also furnished with a control unit (not shown) for controlling the rotation speed of the pump 23 to control the supply pressure of the abrasive slurry 20 in the pipe 22 to a desired pressure. This control unit also controls the opening and closing of the valves provided on the pipe 22.

The second supply unit 3 is adopted to spray and supply additive 30, which constitutes the polishing solution (not shown), into the mixing unit 5. Here, the additive 30 is, for example, an aqueous solution of an organic acid or hydrogen peroxide.

The second supply unit 3 is furnished with the tank 31 for storing the additive 30: the pipe 32 for supplying the additive 30 to the mixing unit 5 from the tank 31; the pump 33 for supplying the additive 30 in the tank 31 to the pipe 32 under a desired pressure; and the spray unit 34 (See FIG. 2; details will be described below.) for spraying the additive 30 supplied through the pipe 32 into the mixing unit 5. Although not shown, a plurality of valves is provided on the pipe 32.

The second supply unit 3 is also furnished with a control unit (not shown) for controlling the rotation speed of the pump 33 to control the supply pressure of the additive 30 in the pipe 32 to a desired pressure. This control unit also controls the opening and closing of the valves provided on the pipe 32.

The third supply unit 4 is adopted to spray and supply pure water 40, which constitutes the polishing solution (not shown), into the mixing unit 5.

The third supply unit 4 is furnished with a tank (not shown) for storing the pure water 40 and the pipe 42 for supplying the pure water 40 to the mixing unit 5 from the tank. In place of the above-described tank, a pure-water supply line, which is an incidental facility of the semiconductor manufacturing plant, may be used.

The third supply unit 4 is also furnished with a pump (not shown) for supplying the pure water 40 in the above-described tank to the pipe 42 under a desired pressure, and a spray unit 44 (See FIG. 2; details will be described below.) for spraying the pure water 40 supplied through the pipe 42 into the mixing unit 5. Although not shown, a plurality of valves is provided on the pipe 42.

When the above-described pure-water supply line is used in place of the tank, the pump for supplying pure water is not required. In this case, a pressure control mechanism, such as a needle valve, can be provided to control the supply pressure of pure water 40.

The third supply unit 4 is also furnished with a control unit (not shown) for controlling the rotation speed of the above-described pump or the above-described pressure control mechanism to control the supply pressure of the pure water 40 in the pipe 42 to a desired pressure. This control unit also controls the opening and closing of the valves provided on the pipe 42.

Also, the third supply unit 4 sprays pure water into the mixing unit 5, when the abrasive slurry 20 is not supplied into the mixing unit 5 for a specified period of time.

Thereby, the adherence of the abrasive slurry 20 on the inner wall of the mixing unit 5, specifically, the adherence of the abrasive grains contained in the abrasive slurry 20 on the inner wall of the mixing unit 5, can be prevented.

Figure 3:
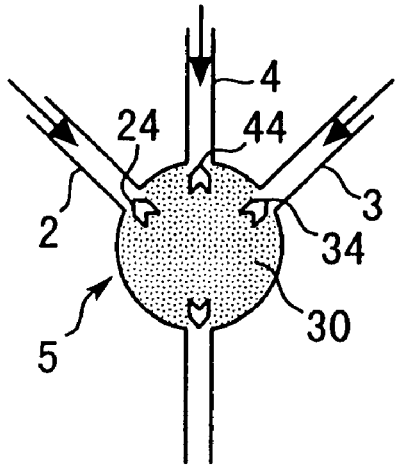
FIG. 3 is a cross-sectional view for describing a method of preventing the adherence of the abrasive slurry on the inner wall of the mixing unit shown in FIG. 1.

As shown in FIG. 3, pure water 40 may be filled in the mixing unit 5 to prevent the adherence of the abrasive slurry 20 on the inner wall of the mixing unit 5.

The above-described spray units 24, 34 and 44 have mechanisms that increase the flow rate of the liquids supplied through pipes 22, 32 and 42, and that release the mist into the mixing unit 5. More specifically, the spray units 24, 34 and 44 are, for example, nozzles of which the diameter becomes sharply thin, or mesh provided at the end of an ejecting portion.

The mixing unit 5 is a vessel made of a material that is anticorrosive to the abrasive slurry 20 and the additive 30 constituting the abrasive slurry, such as polytetrafluoroethylene (Teflon®).

The mixing unit 5 mixes the mist of the abrasive slurry 20 supplied from the first supply unit 2, the mist of the additive 30 supplied from the second supply unit 3 and the mist of the pure water 40 supplied from the third supply unit 4, to prepare the polishing solution. The mixing unit 5 also supplies the polishing solution mixed in the mixing unit 5 onto the major surface of the polishing table 1.

To summarize the above-described polishing solution supply system, the first supply unit 2 sprays and supplies the abrasive slurry 20 into the mixing unit 5; the second supply unit 3 sprays and supplies the additive 30 into the mixing unit 5; the third supply unit 4 sprays and supplies the pure water 40 into the mixing unit 5; and the mixing unit 5 mixes the mist of the abrasive slurry 20, the mist of the additive 30 and the mist of the pure water 40, and supplies the mixture (i.e. polishing solution) onto the major surface of the polishing table 1.

Next, a method of supplying a polishing solution through use of the above-described polishing solution supply system will be described.

First, the control unit (not shown) provided on the first supply unit 2 controls the operation of the pump 23 and the valves (not shown). Thereby, a desired quantity of the abrasive slurry 20 of the abrasive slurry 20 stored in the tank 21 is sprayed into the mixing unit 5.

At the same time, the control unit (not shown) provided on the second supply unit 3 controls the operation of the pump 33 the opening and closing of and the valves (not shown). Thereby, a desired quantity of the additive 30 of the additive 30 stored in the tank 31 is sprayed into the mixing unit 5.

Furthermore, simultaneously with the supply of the abrasive slurry 20 and the additive 30, the control unit (not shown) provided on the third supply unit 4 controls the operation of the pump the opening and closing of and the valves (not shown). Thereby, a desired quantity of the pure water 40 supplied from the tank or the pure-water supply line (not shown) is sprayed into the mixing unit 5.

Next, the mist of the abrasive slurry 20, the mist of the additive 30 and the mist of the pure water 40 supplied into the mixing unit 5 are mixed.

Then, the mixed solution (polishing solution) mixed in the mixing unit 5 is supplied onto the major surface of the polishing table 1.

As described above, in the system and the method of supplying the polishing solution according to the first embodiment, the abrasive slurry 20, the additive 30 and the pure water 40, which are constitutes the polishing solution, are sprayed into the mixing unit 5, and the mist of each material was mixed with each other in the mixing unit 5. Then, the polishing solution mixed in the mixing unit 5 was supplied onto the major surface of the polishing table 1.

Therefore, since the abrasive slurry 20, the additive 30 and the pure water 40 are mixed in the state of mist, the coagulation of the abrasive grain contained in the abrasive slurry 20 can be prevented when the polishing solution is mixed. Thus, the polishing solution can be supplied stably to an apparatus for polishing a semiconductor substrate.

Further, polishing using the polishing solution mixed in the mist state can reduce the occurrence of scratches of semiconductor devices (semiconductor substrates) during polishing. Therefore, the product yield can be improved, and high-quality semiconductor devices can be produced.

Furthermore, since the polishing solution mixed in the mist state contains the additive 30, high flatness can be obtained. Therefore, high flatness can be obtained in the polishing apparatus using the polishing solution supplied by the polishing solution supply system according to the first embodiment.

Next, a modification of the polishing solution supply system according to the first embodiment of the present invention will be described.

Figure 4:
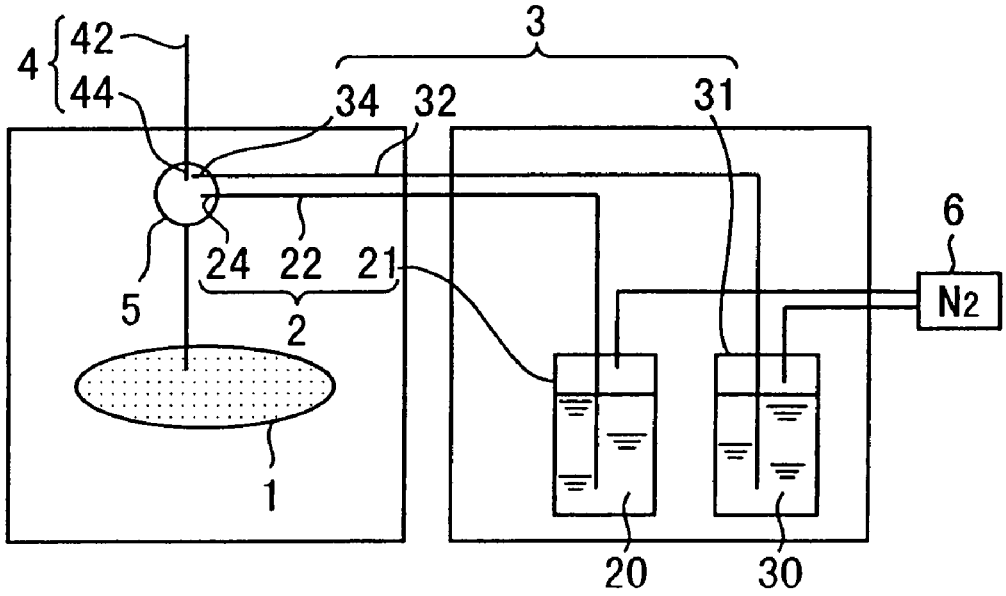
FIG. 4 is a conceptual view for describing a first modification of the polishing solution supply system according to the first embodiment of the present invention.

FIG. 4 is a conceptual view for describing a first modification of the polishing solution supply system according to the first embodiment of the present invention.

The polishing solution supply system shown in FIG. 4 has an essentially identical structure as the polishing solution supply system shown in FIG. 1. Therefore, the same reference numerals are used for the same component parts, and the detailed description thereof is omitted.

The difference from the polishing solution supply system shown in FIG. 1 is the use of a gas supply unit 6 in place of the pumps 23 and 33 for supplying each fluid constituting the abrasive slurry.

Specifically, in the polishing solution supply system shown in FIG. 4, the abrasive slurry 20 or the additive 30 is forced into the pipe 22 or 32 by supplying a gas, such as nitrogen ($N_2$), from the gas supply unit 6 to the tanks 21 and 31. A plurality of the gas supply units 6 may be provided on each of the tanks 21 and 31.

The pressure of the gas supplied to each of the tanks 21 and 31 from the gas supply unit 6 can be controlled by the control unit provided on each gas supply unit 2 or 3. Thereby, the pressure of the abrasive slurry 20 or the additive 30 supplied into the pipes 22 and 32 from of the tanks 21 and 31 can be controlled to the desired pressure.

Figure 5:
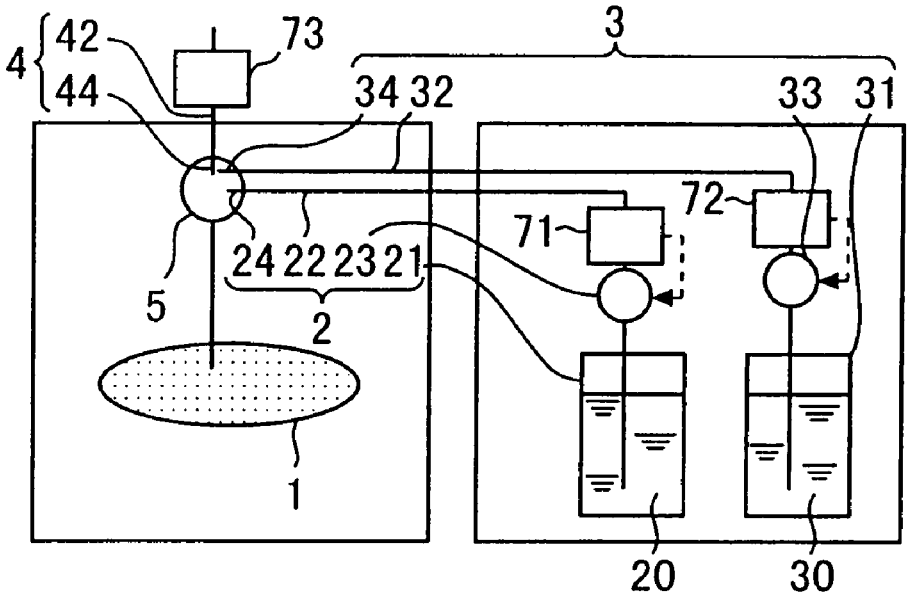
FIG. 5 is a conceptual view for describing a second modification of the polishing solution supply system according to the first embodiment of the present invention.

FIG. 5 is a conceptual view for describing a second modification of the polishing solution supply system according to the first embodiment of the present invention.

The polishing solution supply system shown in FIG. 5 has an essentially identical structure as the polishing solution supply system shown in FIG. 1. Therefore, the same reference numerals are used for the same component parts, and the detailed description thereof is omitted.

The difference from the polishing solution supply system shown in FIG. 1 is the use of flow meters 71, 72 and 73 in the pipes 22, 32 and 42, respectively.

Specifically, the abrasive slurry supply system shown in FIG. 5 is furnished with a flow meter 71 for measuring the flow rate of the abrasive slurry 20 in the pipe 22, a flow meter 72 for measuring the flow rate of the additive 30 in the pipe 32, and a flow meter 73 for measuring the flow rate of the pure water 40 in the pipe 42.

The control unit (not shown) in the first supply unit 2 controls the rotation speed of the pump 21 on the basis of the flow rate value measured by the flow meter 71. Thereby the pressure of the abrasive slurry 20 supplied into the pipe 22 can be controlled to a desired pressure.

The control unit (not shown) in the second supply unit 3 controls the rotation speed of the pump 31 on the basis of the flow rate value measured by the flow meter 72. Thereby the pressure of the additive 30 supplied into the pipe 32 can be controlled to a desired pressure.

Also, the control unit (not shown) in the third supply unit 4 controls the rotation speed of the pump (not shown) on the basis of the flow rate value measured by the flow meter 73. Thereby the pressure of the pure water 40 supplied into the pipe 42 can be controlled to a desired pressure.

Therefore, the supply pressure of the abrasive slurry 20, the additive 30 and the pure water 40 constituting the polishing solution is subjected to feedback control on the basis of the measuring results (sensing signals) of the flow meters 71, 72 and 73. Thereby, the supply pressure of the abrasive slurry 20, the additive 30 and the pure water 40 can be controlled at a high accuracy.

Figure 6:
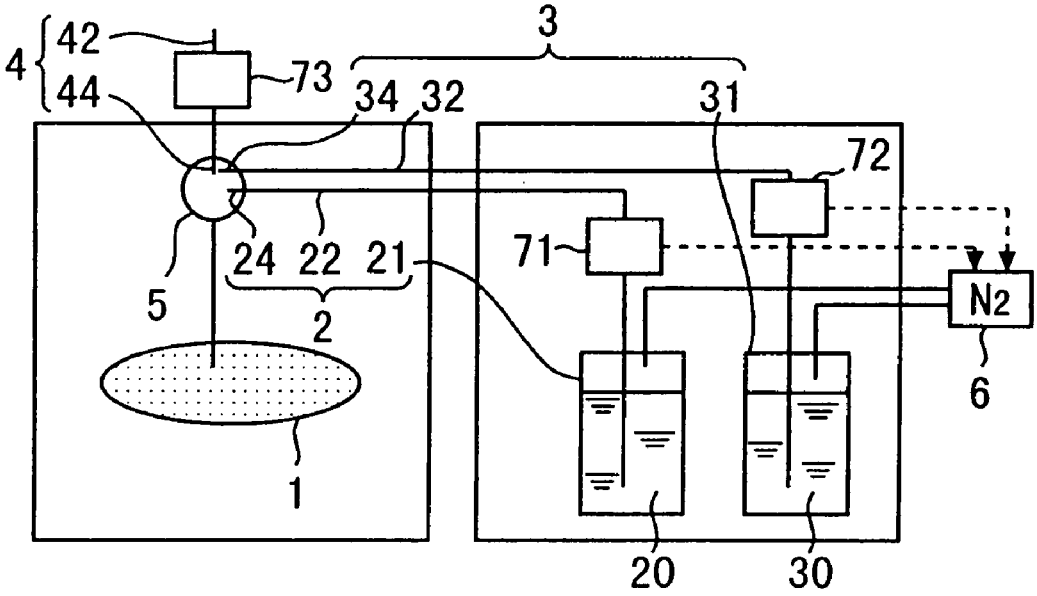
FIG. 6 is a conceptual view for describing a third modification of the polishing solution supply system according to the first embodiment of the present invention.

FIG. 6 is a conceptual view for describing a third modification of the polishing solution supply system according to the first embodiment of the present invention.

The polishing solution supply system shown in FIG. 6 has an essentially identical structure as the polishing solution supply system shown in FIG. 1. Therefore, the same reference numerals are used for the same component parts, and the detailed description thereof is omitted.

The difference from the polishing solution supply system shown in FIG. 1 is the use of a gas supply unit 6 in place of the pumps 23 and 33 for supplying each fluid constituting the polishing solution, and the use of flow meters 71, 72 and 73 in the pipes 22, 32 and 42 respectively.

In the polishing solution supply system shown in FIG. 6, the abrasive slurry 20 or the additive 30 is forced into the pipe 22 or 32 by supplying a gas, such as nitrogen ($N_2$), to the tank 21 or 31 from the gas supply unit 6.

The pressure of the abrasive slurry 20 or the additive 30 forced into the pipe 22 or 32 is controlled by the pressure of the gas supplied into each of the tank 21 or 31 from the gas supply unit 6.

Here, the pressure of the gas supplied from the gas supply unit 6 is subjected to feedback control on the basis of the flow rate values measured by the flow meters 71 and 72. Also the control unit (not shown) controls the pressure of the pure water 40 on the basis of the flow rate value measured by the flow meter 73 installed on the pipe 42.

Therefore, the supply pressure of the abrasive slurry 20, the additive 30 and the pure water 40 can be controlled at a high accuracy.

Second Embodiment

Figure 7:
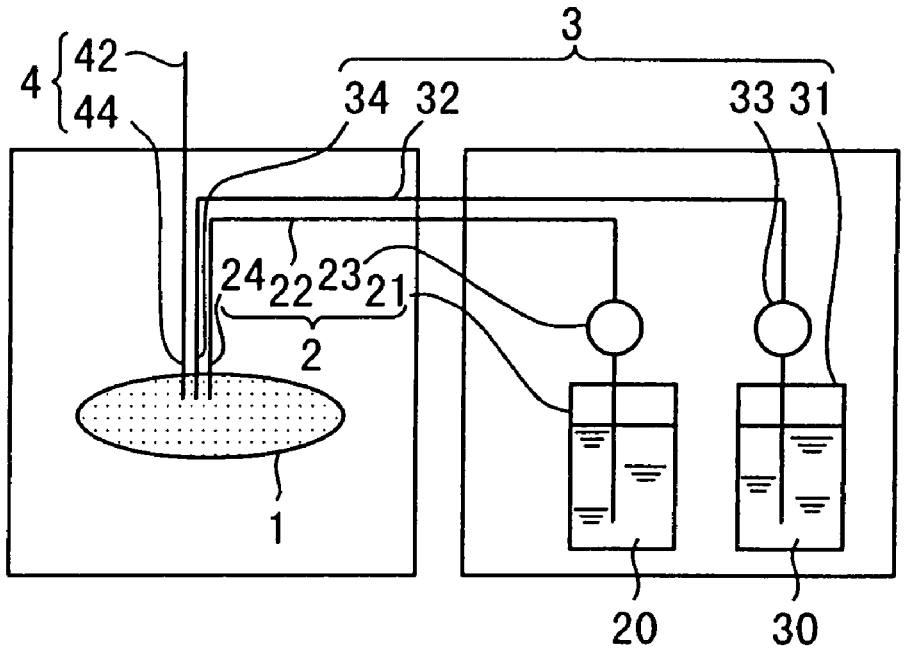
FIG. 7 is a conceptual view for describing a polishing solution supply system and a method of supplying polishing solution according to a second embodiment of the present invention.
Figure 8:
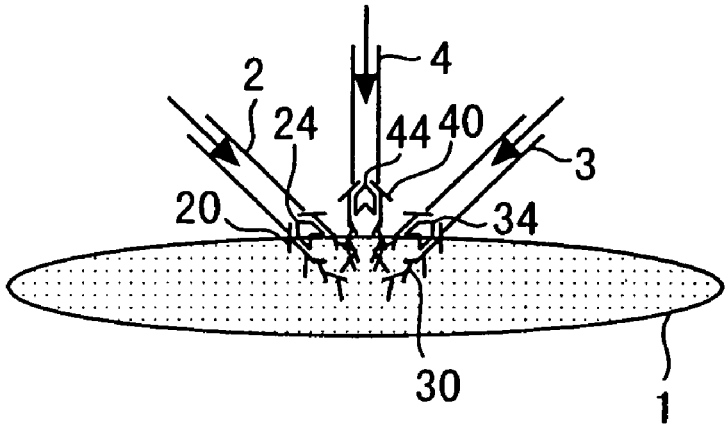
FIG. 8 is a cross-sectional view for describing the vicinity of the polishing table shown in FIG. 7.
Figure 9A:
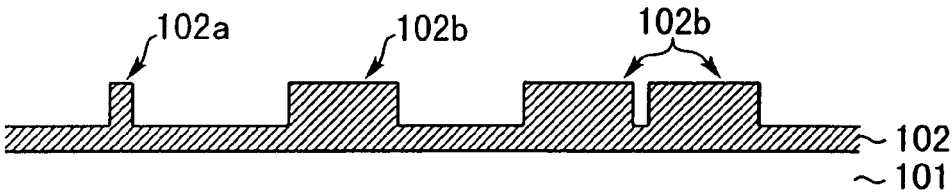
Fig. 9A BACKGROUND ART
FIGS. 9A to 9C are cross-sectional views for describing a conventional method of manufacturing a semiconductor device using a CMP method.
Figure 9B:
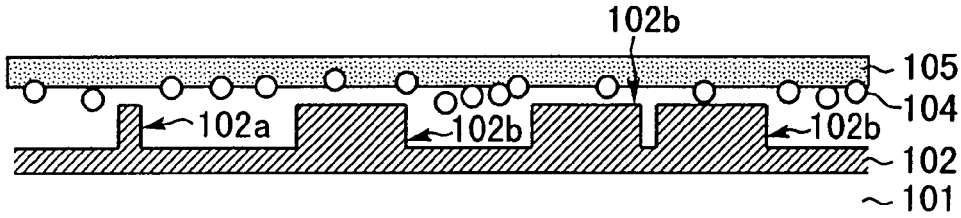
Fig. 9B BACKGROUND ART
Figure 9C:
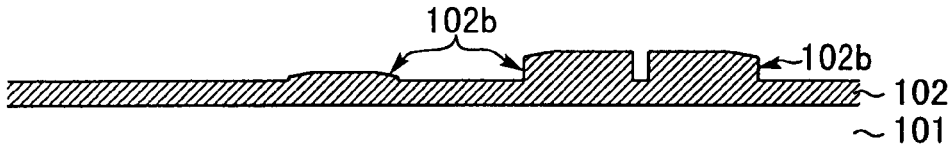
Figure 10:
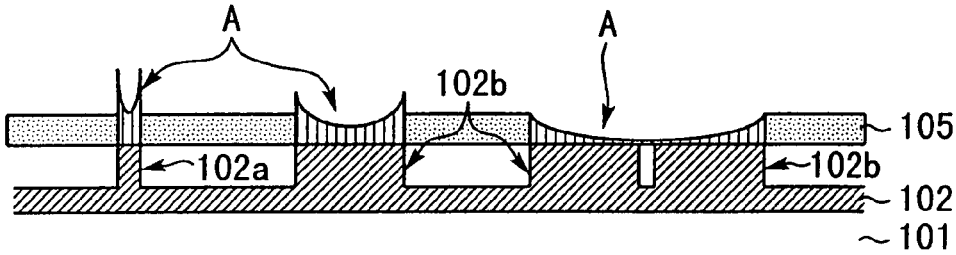
FIG. 10 is a cross-sectional view for describing the stress distribution applied to a polishing stage.
Figure 11A:
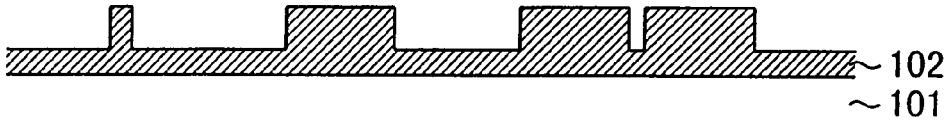
BACKGROUND ART Fig. 11A
FIGS. 11A to 11D are cross-sectional views for describing a conventional method for improving flatness.
Figure 11B:
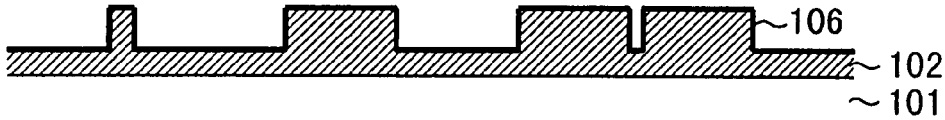
BACKGROUND ART Fig. 11B
Figure 11C:
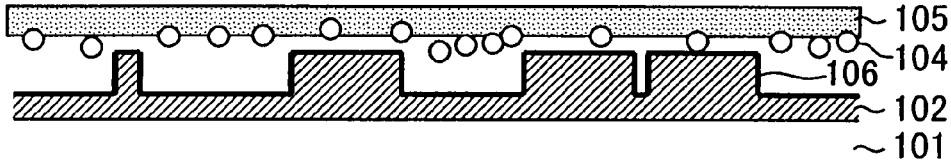
BACKGROUND ART Fig. 11C
Figure 11D:
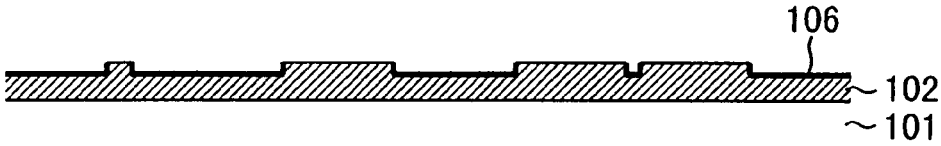
BACKGROUND ART Fig. 11D
Figure 12:
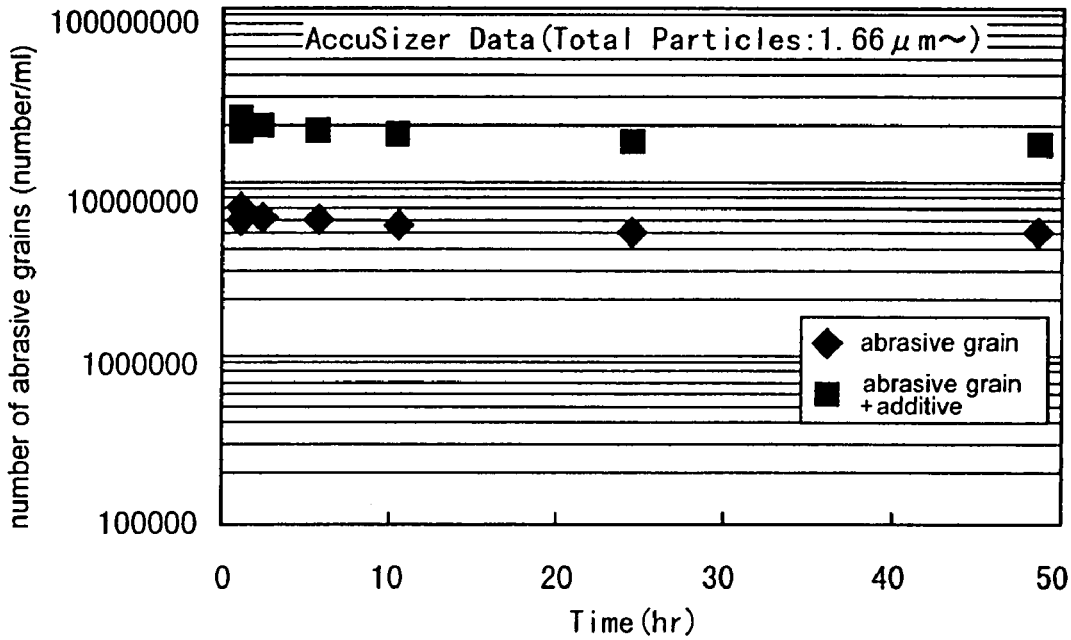
BACKGROUND ART Fig. 12
FIG. 12 is a drawing for describing change in the number of abrasive grains contained in polishing solution.

FIG. 7 is a conceptual view for describing a polishing solution supply system and a method of supplying polishing solution according to a second embodiment of the present invention. FIG. 8 is a cross-sectional view for describing the vicinity of the polishing table shown in FIG. 7.

First, a polishing solution supply system according to a second embodiment will be described.

In FIGS. 7 and 8, the reference numeral 1 indicates a polishing table, 2 indicates a first supply unit, 3 indicates a second supply unit, and 4 indicates a third supply unit.

The polishing table 1 is a polishing pad (also called "CMP pad"). Although not shown, a semiconductor substrate is disposed on the major surface of the polishing table 1.

The first supply unit 2 is furnished with a tank 21 for storing abrasive slurry 20 that contains abrasive grains consisting, for example, of silica or ceria; a pipe 22 for supplying the abrasive slurry 20 from the tank 21 onto the polishing table 1; a pump 23 for supplying the abrasive slurry 20 in the tank 21 into the pipe 22 under a desired pressure; and a spray unit 24 (see FIG. 8) for spraying the abrasive slurry 20 supplied through the pipe 22 onto the specified location on the polishing stage 1.

The second supply unit 3 is furnished with a tank 31 for storing additive 30 consisting, for example, of an aqueous solution of an organic acid or an aqueous solution of hydrogen peroxide; a pipe 32 for supplying the additive 30 from the tank 31 onto the polishing table 1; a pump 33 for supplying the additive 30 in the tank 31 into the pipe 32 under a desired pressure; and a spray unit 34 (see FIG. 8) for spraying the additive 30 supplied through the pipe 32 onto the specified location on the polishing stage 1. Here, the spray unit 34 sprays the additive 30 on the polishing stage 1 so as to mix with the mist of the abrasive slurry 20 sprayed from the spray unit 24 of the first supply unit 2.

The third supply unit 4 is furnished with a tank (not shown) for storing pure water 40, and a pipe 42 for supplying the pure water 40 from the tank onto the polishing table 1. The above-described pure-water supply line may be used in place of the tank.

The third supply unit 4 is also furnished with a pump (not shown) for supplying the pure water 40 in the tank into the pipe 42 under a desired pressure, and a spray unit 44 (see FIG. 8) for spraying the pure water 40 supplied through the pipe 42 onto the specified location on the polishing stage 1. Here, the spray unit 44 sprays the pure water 40 on the polishing stage 1 so as to mix with the mist of the abrasive slurry 20 sprayed from the spray unit 24 of the first supply unit 2 and the mist of the additive 30 sprayed from the spray unit 34 of the second supply unit 3.

To summarize the above-described polishing solution supply system, the first supply unit 2 sprays and supplies the abrasive slurry 20 onto the specified location of the polishing table 1; the second supply unit 3 sprays and supplies the additive 30 onto the polishing table 1 so as to mix with the mist of the abrasive slurry 20 supplied from the first supply unit 2; and the third supply unit 4 sprays and supplies the pure water 40 onto the polishing table 1 so as to mix with the mist of the abrasive slurry 20 supplied from the first supply unit 2 and the mist of the additive 30 supplied from the second supply unit 3.

Next, a method of supplying a polishing solution through use of the above-described polishing solution supply system will be described.

First, a control unit (not shown) provided on the first supply unit 2 controls the operation of the pump 23 and valves (not shown) installed on the pipe 22. Thereby, a desired quantity of the abrasive slurry 20 stored in the tank 21 is sprayed and supplied on to the specified location of the polishing stage 1.

At the same time, a control unit (not shown) provided on the second supply unit 3 controls the operation of the pump 33 and valve (not shown) installed on the pipe 32. Thereby, a desired quantity of the additive 30 stored in the tank 31 is sprayed onto the polishing stage 1 so as to mix with the additive in the mist state.

Furthermore, simultaneously with the supply of the abrasive slurry 20 and the additive 30, a control unit (not shown) provided on the third supply unit 4 controls the operation of the pump and valves (not shown) installed on the pipe 42. Thereby, a desired quantity of the pure water 40 supplied from the tank or the pure-water supply line (not shown) is sprayed and supplied onto the polishing stage 1 so as to mix with the additive 20 and additive 30 in the mist state.

Thus, the abrasive slurry 20, the additive 30 and the pure water 40 supplied from the supply units 2, 3 and 4, respectively, are sprayed and supplied onto the polishing stage 1. On the polishing stage 1, each of fluids 20, 30 and 40 are mixed in the mist state.

As described above, in the system and the method of supplying the polishing solution according to the second embodiment, the abrasive slurry 20, the additive 30 and the pure water 40, which are constitutes the polishing solution, are sprayed and supplied onto the major surface of the polishing table 1 so as to mix with each other.

Thereby, the abrasive slurry 20, the additive 30 and the pure water 40 are mixed with each other in the mist state on the polishing stage 1, and the polishing solution is prepared.

Therefore, the coagulation of the abrasive grain contained in the abrasive slurry 20 can be prevented when the polishing solution is mixed. Thus, the polishing solution can be supplied stably to an apparatus for polishing a semiconductor substrate.

Further, polishing using the polishing solution mixed in the mist state can reduce the occurrence of scratches of semiconductor devices (semiconductor substrates) during polishing. Therefore, the product yield can be improved, and high-quality semiconductor devices can be produced.

Furthermore, since the polishing solution mixed in the mist state contains the additive 30, high flatness can be obtained. Therefore, high flatness can be obtained in the polishing apparatus using the polishing solution supplied by the polishing solution supply system according to the second embodiment.

In the second embodiment, although each fluid constituting the polishing solution is supplied using pump 23 or 33, the structure that each fluid is forced into the pipe by supplying a gas from a gas supply unit to the tank, as the polishing solution supply system shown in FIG. 4, may be used.

Also, a flow meter may be installed on each of the pipes 22, 32 and 42. In this case, the control units provided in supply units 2, 3 and 4 control the rotation speeds of the pumps 23 and 33, or the pressure of the gas supplied from the gas supply unit, on the basis of the flow rate of each fluid measured by the flow meters.

Therefore, the supply pressure of the abrasive slurry 20, the additive 30 and the pure water 40 can be controlled at a high accuracy.

This invention, when practiced illustratively in the manner described above, provides the following major effects:

According to a first aspect of the present invention, the coagulation of abrasive grains can be prevented when the mist of abrasive slurry, the mist of additive and the mist of pure water are mixed in a mixing unit to prepare the polishing solution.

According to a second aspect of the present invention, the coagulation of abrasive grains can be prevented when the mist of abrasive slurry, the mist of additive and the mist of pure water are mixed on a polishing table to prepare the polishing solution.

In a preferred variation of the present invention, each fluid constituting the polishing solution can be sprayed and supplied to the mixing unit under a desired pressure.

In a preferred variation of the present invention, each fluid constituting the polishing solution can be sprayed and supplied onto the polishing stage under a desired pressure.

In a preferred variation of the present invention, the supply pressure of each fluid constituting the polishing solution can be controlled at a high accuracy.

In a preferred variation of the present invention, abrasive slurry having a special property of excellent flatness can be mixed without coagulating the abrasive grains.

In a preferred variation of the present invention, the coagulation of the abrasive grains can be prevented, when the mist of abrasive slurry, the mist of additive and the mist of pure water are mixed in the mixing unit to prepare the polishing solution. Therefore, the occurrence of the scratches of a semiconductor substrate during polishing can be reduced.

In a preferred variation of the present invention, the coagulation of the abrasive grains can be prevented, when the mist of abrasive slurry, the mist of additive and the mist of pure water are mixed on the polishing table to prepare the polishing solution. Therefore, the occurrence of the scratches of a semiconductor substrate during polishing can be reduced.

In a preferred variation of the present invention, the adherence of abrasive grains on the inner wall of the mixing unit can be prevented.

In a preferred variation of the present invention, since the occurrence of the scratches of the semiconductor substrate during polishing can be reduced, semiconductor devices of high quality can be manufactured.

Further, the present invention is not limited to these embodiments, but variations and modifications may be made without departing from the scope of the present invention.

The entire disclosure of Japanese Patent Application No. 2000-363478 filed on Nov. 29, 2000 containing specification, claims, drawings and summary are incorporated herein by reference in its entirety.

What is claimed is:

1. An apparatus including a polishing solution supply system, the polishing solution supply system comprising:

a polishing table for placing a semiconductor substrate on a major surface thereof;

a first supply unit for spraying and supplying a mist comprising abrasive slurry;

a second supply for spraying and supplying a mist comprising additive;

a third supply unit for spraying and supplying a mist comprising pure water; and a mixing unit for mixing the mist of abrasive slurry supplied from said first supply unit, the mist of additive supplied from said second supply unit and the mist of pure water supplied from said third supply unit to form a polishing mixture, said missing unit supplying the polishing mixture onto said major surface of said polishing table, wherein each of said supply units comprises:

a tank for storing liquid;

a pipe for supplying said liquid from said tank to said mixing unit;

a pump for supplying said liquid in said tank to said pipe at a pressure, or a gas supply unit for supplying a gas into said tank so as to supply said liquid in said tank to said pipe at a specified pressure;

a control unit for controlling the pressure of said liquid in said pipe at a flow rate; and a spray unit for spraying said liquid supplied from said pipe into said mixing unit, and wherein said additive is an aqueous solution of organic acid, or an aqueous solution of hydrogen peroxide.

* * * * *